United States Patent [19]

Grieb et al.

[11] Patent Number: 4,475,586

[45] Date of Patent: Oct. 9, 1984

[54] HEAT EXCHANGER

[75] Inventors: Hubert Grieb, Germering; Wilfried Klussmann, Dachau, both of Fed. Rep. of Germany

[73] Assignee: MTU Motoren-Und Turbinen Union Munchen GmbH, Munich, Fed. Rep. of Germany

[21] Appl. No.: 362,575

[22] Filed: Mar. 26, 1982

Related U.S. Application Data

[63] Continuation of Ser. No. 89,825, Oct. 31, 1979, abandoned.

[30] Foreign Application Priority Data

Feb. 28, 1979 [DE] Fed. Rep. of Germany ..... 2907810

[51] Int. Cl.[3] ..... F28D 7/06; F28F 1/04; F28F 1/42

[52] U.S. Cl. ..... 165/134 R; 165/145; 165/151; 165/163; 165/172; 165/174; 165/176; 165/DIG. 9; 165/DIG. 13

[58] Field of Search ..... 165/145, 157, 151, 152, 165/166, 177, 134 R, 148, DIG. 9, 163, 174; 164/164, 165, 172, 176, DIG. 13

[56] References Cited

U.S. PATENT DOCUMENTS

| | | | |
|---|---|---|---|
| 1,125,027 | 1/1915 | Kretschmer | 165/172 |
| 1,421,542 | 7/1922 | Ochsner | 165/151 |
| 1,618,485 | 2/1927 | Skimmer | 165/151 |
| 2,620,169 | 12/1952 | Gross et al. | 165/157 |
| 2,733,899 | 2/1956 | Lehmann | 165/151 X |
| 3,129,756 | 4/1964 | Ramen | 165/157 |
| 3,228,464 | 1/1966 | Stein et al. | 165/166 |
| 3,255,818 | 6/1966 | Beam, Jr. et al. | 165/166 |
| 3,746,083 | 7/1973 | Tiefenbacher | 165/157 |
| 3,866,674 | 2/1975 | Trumuta et al. | 165/145 |
| 4,036,293 | 7/1977 | Tank | 165/145 |

FOREIGN PATENT DOCUMENTS

| | | | |
|---|---|---|---|
| 282459 | 3/1914 | Fed. Rep. of Germany | 165/177 |

*Primary Examiner*—Sheldon J. Richter
*Attorney, Agent, or Firm*—Alan H. Levine

[57] ABSTRACT

A heat exchanger with at least one main tube, closed off at one end, into which compressed air, which is to be heated, is admitted and, after being heated, is removed. The main tube has at least two channel guideways which are separated from one another in the longitudinal direction. U-shaped or curved compressed air lines project from the main tube and contact the hot gases. Each compressed air line is connected at one end to the channel guideway of the main tube into which compressed air is admitted, and at its other end with the channel guideway through which the heated compressed air is removed. The compressed air lines are formed primarily from hollow bodies, which extend in the direction of flow of the hot gas and which preferably are tapered at the inflow and outflow ends in order to aid the flow.

8 Claims, 15 Drawing Figures

MATRIX DENSITY $O_{GAS}/V_{MATRIX} = 1000 \div 1500 \frac{m^2}{m^3}$

PLATE HEAT EXCHANGER - MATRIX FOR CROSS FLOW

MATRIX DENSITY $O_{Gas}/V_{Matrix} = 1000 \div 1500 \frac{m^2}{m^3}$

PLATE HEAT EXCHANGER-MATRIX FOR CENTRAL CROSS/COUNTER FLOW

COMPRESSED AIR FLOWS WITHIN THE PROFILES

ARRANGEMENT AND FLOW THROUGH THE PROFILES

ARRANGEMENT AND FLOW THROUGH OFFSET PLATES OF FINITE LENGTH, EQUIVALENT ON THE GAS SIDE

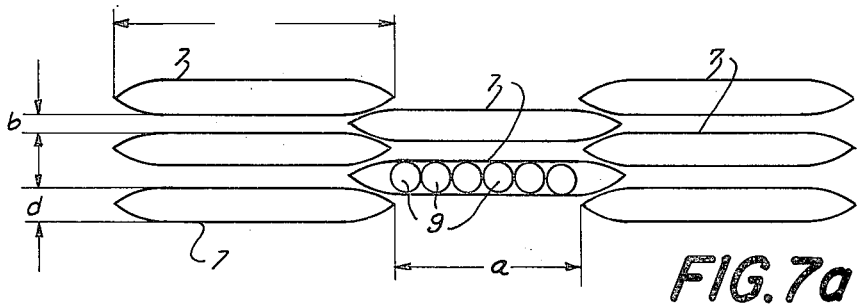
FIG. 7a
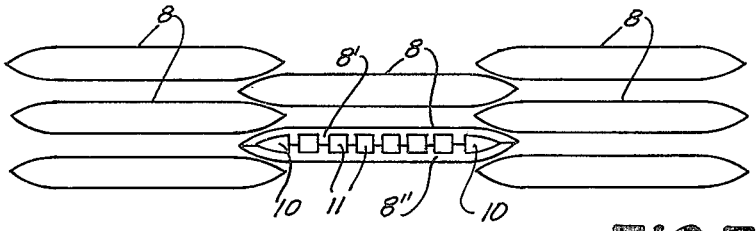
FIG. 7b
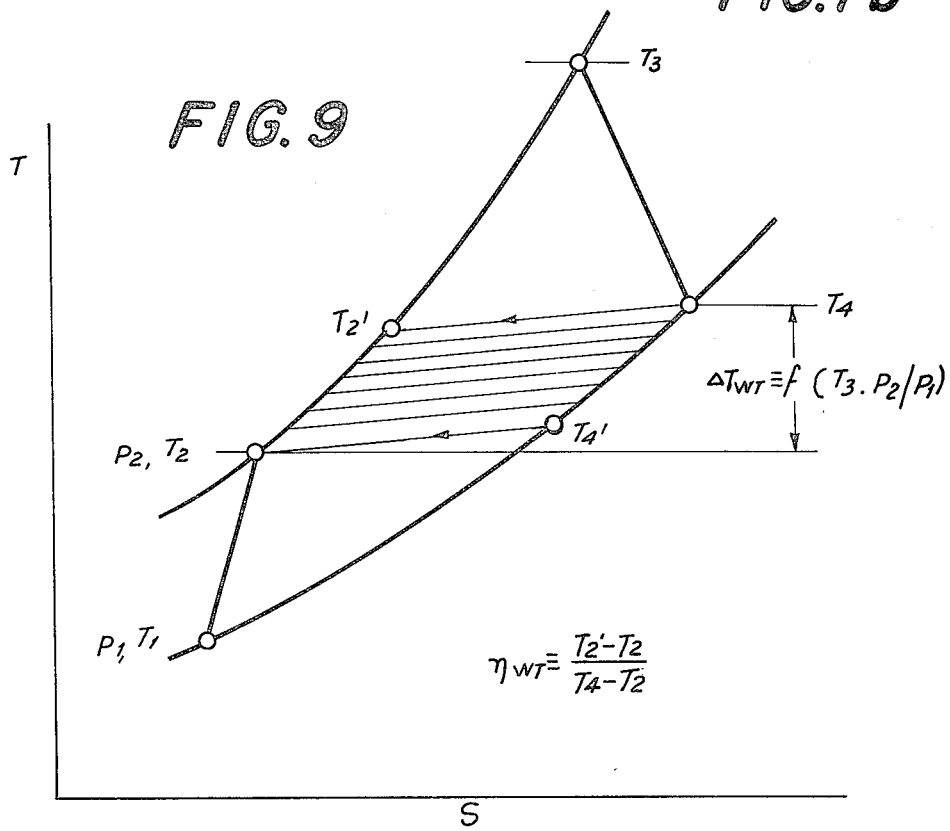
EFFECT OF THE INLET TEMPERATURE $T_4$ PERMISSIBLE ON THE GAS SIDE OF THE HEAT EXCHANGER, ON THE TEMPERATURE GRADIENT $\Delta T_{WT}$ OF THE HEAT EXCHANGER

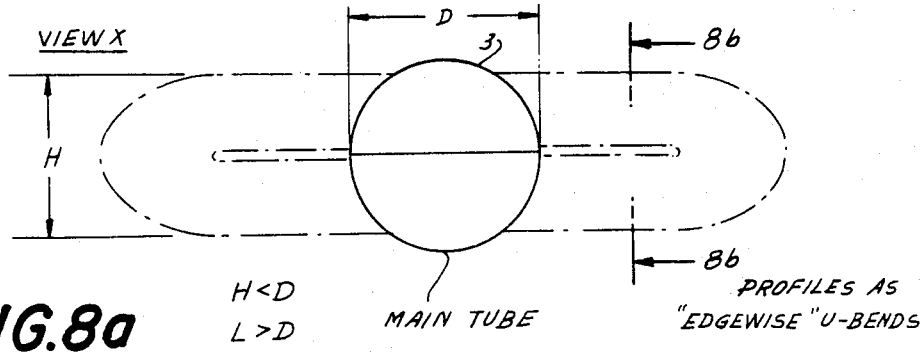
FIG.8a
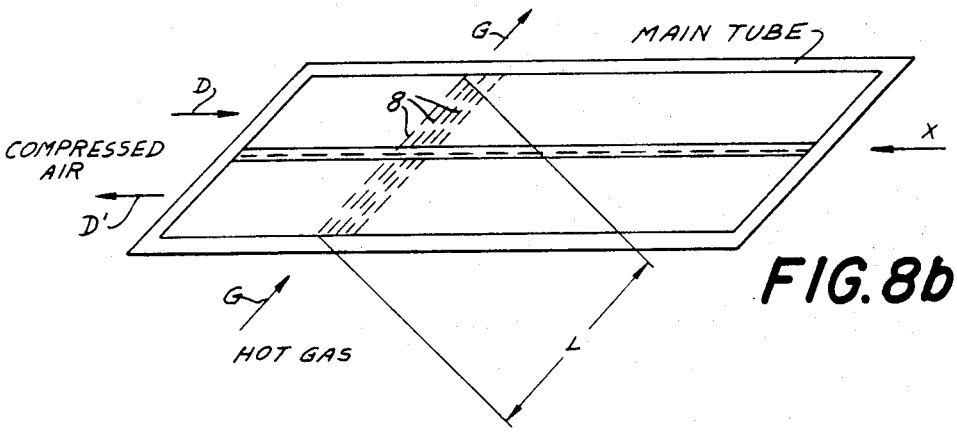
FIG.8b
FIG.10
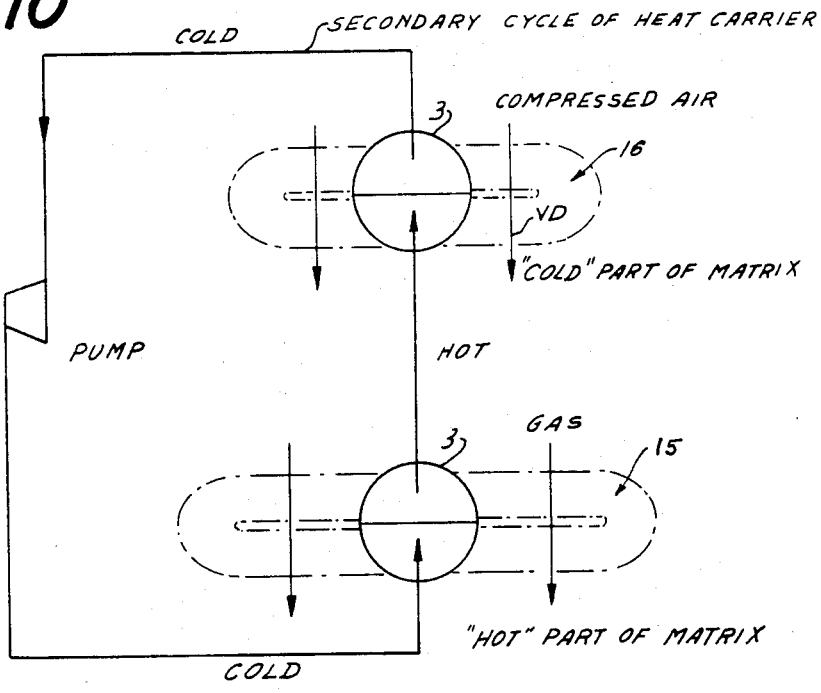

HEAT EXCHANGER

This application is a continuation of application Ser. No. 89,825, filed Oct. 31, 1979, now abandoned.

The invention relates to a heat exchanger with at least one main tube, closed off at one end, into which compressed air, which is to be heated, is admitted and, after being heated, is carried away. The main tube has at least two channel guideways, which are separated from one another in the longitudinal direction, and U-shaped or curved compressed air lines are provided projecting from the main tube and in contact with the hot gases. Each compressed air line is connected at one end to the channel guideway of the main tube which is intended for the admission of compressed air, and at its other end to the channel guideway which is intended for the carrying away of heated compressed air.

The heat exchanger described above is a typical embodiment of a tubular heat exchanger with which a simple cross flow/counterflow is obtainable. The hot gas, which is to be cooled, flows through the tubes arranged in U-shaped fashion, while the compressed air, which is to be heated, flows in cross/countercurrent flow in the main tube, as stated above. The U-tubes are connected in bundles with a main tube, whose function it is to admit and to carry away the compressed air. While the employment of tubes to carry the flow of hot gas provides an intensive heat transfer from the gases, at the same time it causes considerable flow losses.

The advantages of this tubular heat exchanger construction are:

high permissible gas inlet temperatures and therefore high obtainable temperature gradients of the gas and air;

extremely low sensitivity to thermal shock as a result of the free heat expansion of the U-tube without stress on the connection between the U-tube and the main tube;

low incidence of leakage; and simple construction of the gas and air guideways.

The disadvantages on the other hand are:

moderate matrix density (exchange surface area per unit volume) in the case of acceptable tube diameters;

limited aerodynamic effectiveness (heat efficiency/-friction) because of an unfavorable configuration of flow on the gas side;

low resistance of the U-tubes to vibrational stresses and sudden loads.

Other heat exchangers are known having plate heat exchanger matrices for cross flow and simple cross-/counterflow. These matrices consist essentially of equidistantly spaced-apart plates, which separate the gas and the air from one another, and which are kept at a fixed distance apart by, for example, corrugated metal plate inserts having saw-toothed or wave-shaped cross sections. These inserts are used for the purpose of bringing a maximum amount of heat to the spaced-apart plates and therefore contribute only indirectly to the heat exchange of gas and air. The advantages of this principle are:

high matrix density;

high effectiveness, that is, an advantageous ratio of heat exchange to friction; and a high resistance to vibrational stresses and sudden loads.

The following disadvantages, however, must be taken into account:

high thermal loads (expansions or stresses) as a result of locally different temperatures; consequently, a limited maximum permissible gas temperature;

high thermal shock sensitivity;

difficulty with sealing air/gas;

difficulty with integrating the matrix in the intake and outlet channels.

It is an object of the invention to improve a heat exchanger of the type mentioned at the beginning in such a manner over known heat exchangers, that the respective advantages of the tube and plate heat exchangers may be combined and the disadvantages at the same time eliminated to the greatest extent possible.

This object is accomplished mainly by providing conduits which are formed from hollow bodies which extend in the direction of flow of the hot gas and which preferably are tapered at the inlet and outlet ends in order to aid the flow.

Additional objects and advantages of the invention will be apparent from the following description.

The invention is explained further by means of the drawings, in which:

FIG. 1 is a schematic perspective view of a conventional heat exchanger;

FIG. 2*a* is an end view of the heat exchanger of FIG. 1;

FIG. 2*b* is a fragmentary cross-sectional view taken along line 2*b*–2*b* of FIG. 2*a;*

Figure 5:
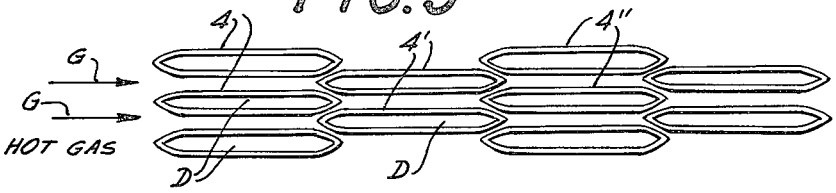
FIG. 5 illustrates an arrangement of bodies, forming part of a heat exchanger of this invention, within which compressed air to be heated flows.

FIGS. 7*a* and 7*b* show more detailed embodiments of the bodies of FIG. 5;

FIG. 8*a* is a schematic end view of a heat exchanger according to this invention;

FIG. 8*b* is a fragmentary cross-sectional view taken along line 8*b*—8*b* of FIG. 8*a;*

Figure 11:
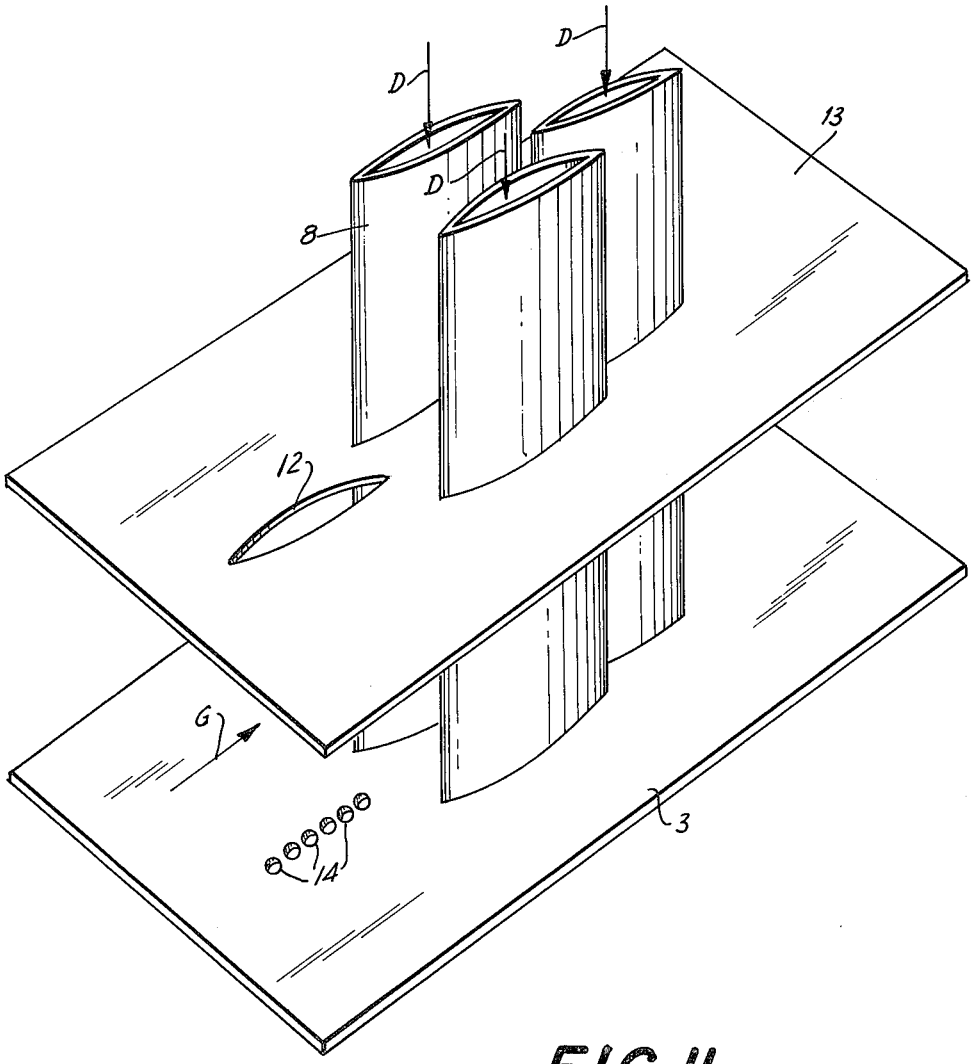
Figure 12:
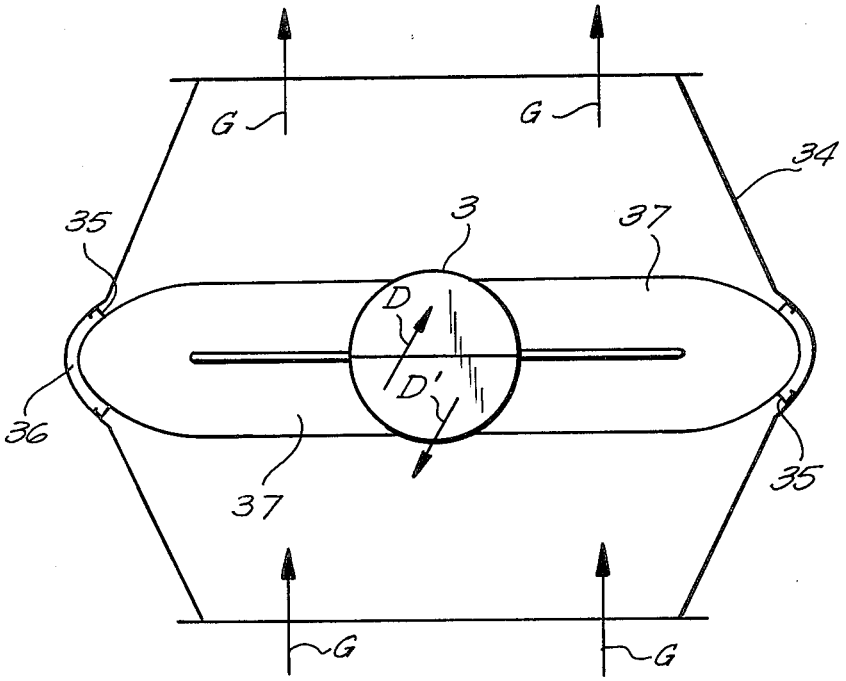

FIG. 9 is a graph illustrating the effect of inlet temperature of hot gas on temperature gradient between gas and air;

FIG. 10 is a schematic representation of an indirect heat exchanger;

FIG. 11 is a perspective view showing the bodies through which compressed air flows combined with baffle plates; and FIG. 12 is a schematic end view of a heat exchanger according to this invention, within a housing.

Figure 1:
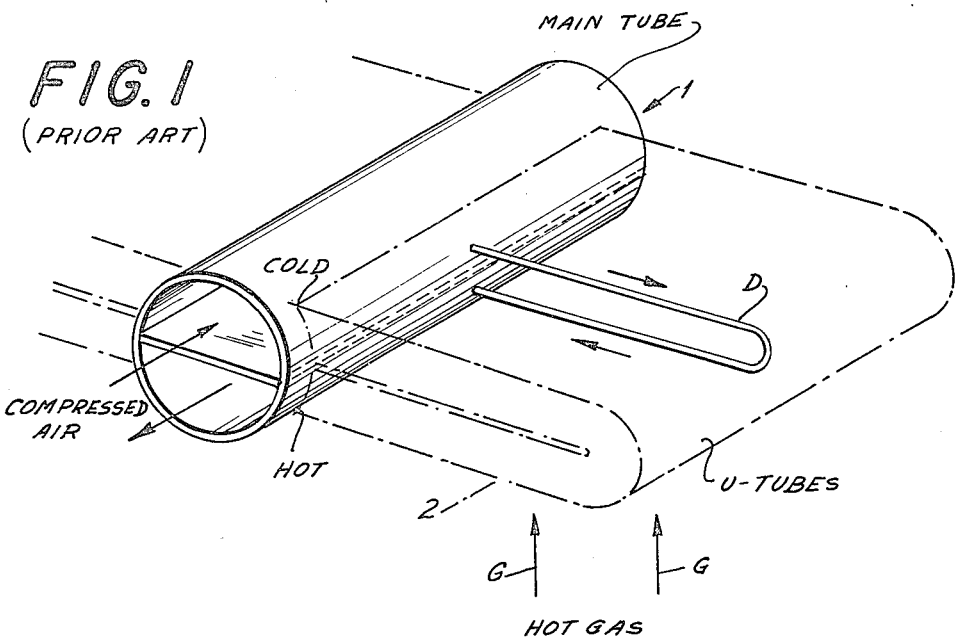
FIG. 1 (PRIOR ART)

In FIG. 1, a typical embodiment of a tube heat exchanger 1 is shown, in which a simple cross/counterflow is employed. The hot gas G, which is to be cooled, flows at right angles to tubes 2, which are arranged in U-shaped fashion, while the compressed air D, which is to be heated, flows in tubes 2, as mentioned above, in cross/counterflow. The U-tubes 2 are connected in bundles with a main tube 3, which provides for the intake and outflow of the compressed air. The compressed air which is supplied to the main tube 3 is labeled D, while the heated compressed air, which is discharged from the main tube 3, is labeled D'.

Figure 2A:
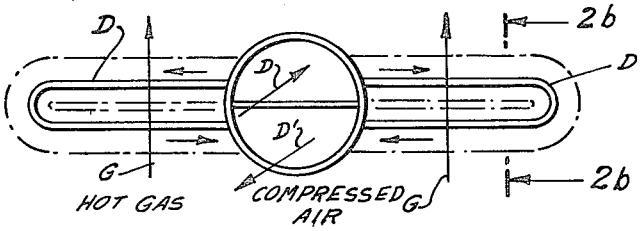
FIG. 2a (PRIOR ART)
Figure 2B:
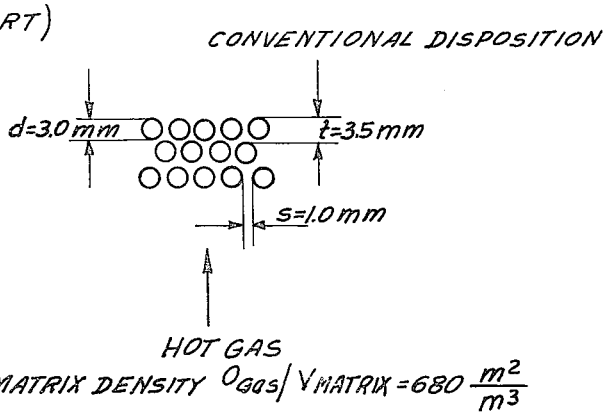
FIG. 2b (PRIOR ART)

FIG. 2*b* shows the usual disposition of tubes 2, as seen along Section 2*b*—2*b* of FIG. 2*a,* which admittedly results in an intensive transfer of heat on the gas side, but at the same time causes considerable flow loses.

The advantages of this tubular heat exchanger construction are:

high permissible inlet temperatures on the gas side and therefore high obtainable temperature gradients of gas and air;

extremely low thermal shock sensitivity as a result of the free heat expansion of the U-tubes without stress on the connection between the U-tube and the main tube;

low incidence of leakage; and simple construction of the gas and air conduits.

The disadvantages on the other hand are:

moderate matrix density (exchange surface area per unit volume) in the case of acceptable tube diameters;

limited aerodynamic effectiveness (heat exchanger performance/friction) because of the unfavorable configuration of flow on the gas side; and slight resistance of U-tubes to vibrational stresses and sudden loads.

Figure 3:
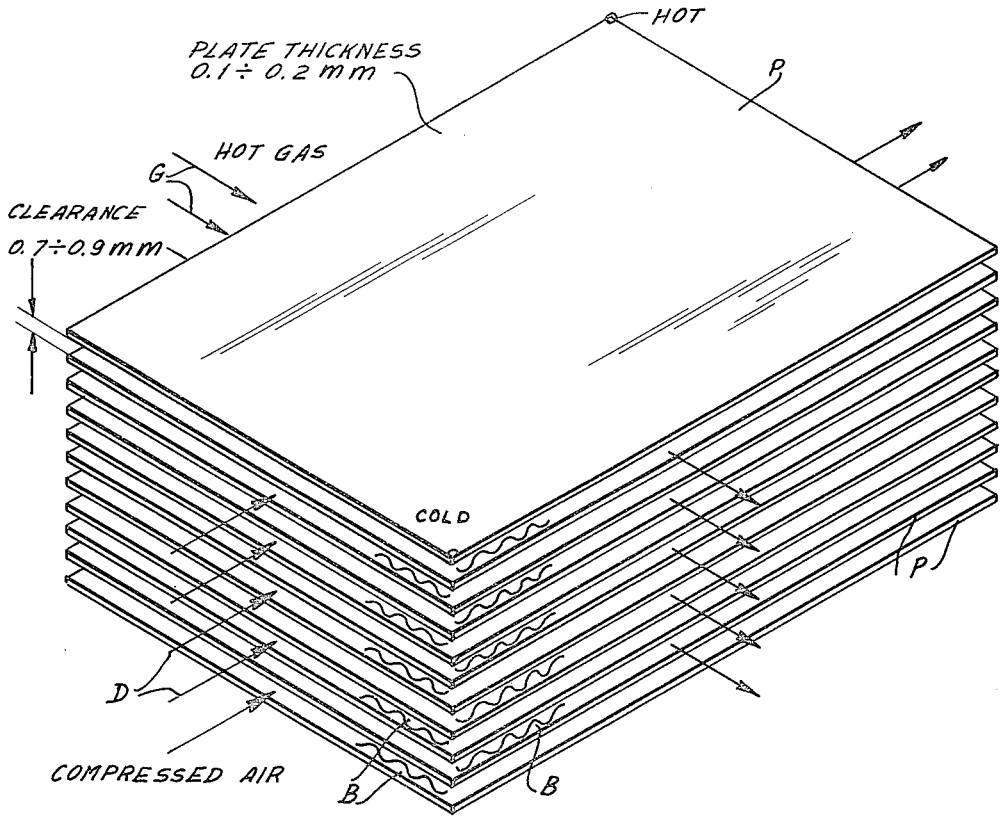
FIG. 3 (PRIOR ART)
FIGS. 3 and 4 are schematic perspective views of other types of conventional heat exchangers.
Figure 4:
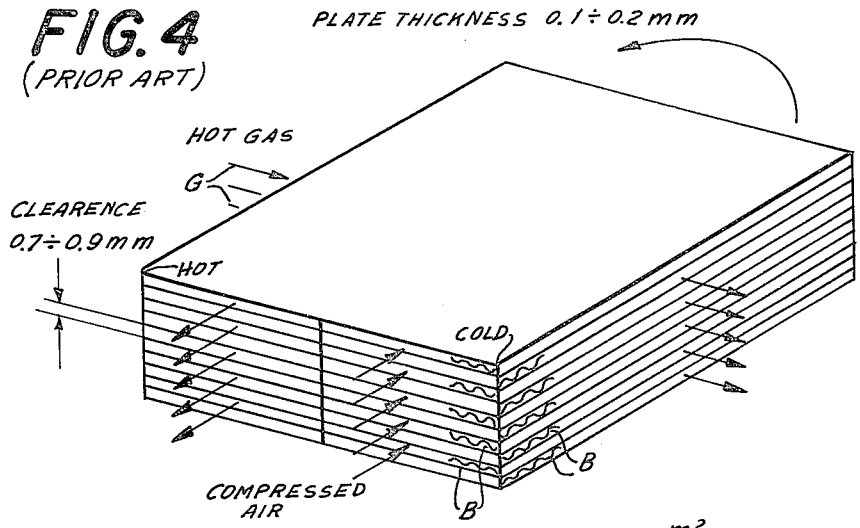
FIG. 4 (PRIOR ART)

FIGS. 3 and 4 illustrate typical plate heat exchanger matrices for cross flow and simple cross/counterflow. Essentially, the matrices consist of equidistantly spaced-apart plates P, which separate the hot gas G and the compressed air D from each other, and which are kept a fixed distance apart by, for example, saw-toothed or wave-shaped metal plate inserts B. The inserts B are used for the purpose of bringing a maximum amount of heat to the spaced-apart plates P and therefore contribute only indirectly to the heat exchange of gas and air. The advantages of this principle are:

high matrix density;

high effectiveness, that is, an advantageous ratio of heat exchange performance to friction; and high resistance to vibrational stresses and sudden loads.

The following disadvantages, however, must be taken into account:

high thermal load (expansion or stresses) as a result of locally different temperatures; consequently, limited maximum permissible gas temperatures;

high thermal shock sensitivity;

difficulty with sealing air and gas; and difficulty with integrating the matrix into the intake and outlet channels.

The object of the heat exchanger concept of this invention is to combine the respective advantages of the tube and plate heat exchangers and at the same time to eliminate the disadvantages, as far as possible. For this purpose, the overall construction and arrangement of the matrix are similar in principle to those of the tubular heat exchanger 1 of FIG. 1. According to the invention, however, the U-tubes 2 of FIG. 1 are replaced by U-profiles or profile bodies 4, 4', 4'', which in principle may be arranged as shown in FIG. 5. As in the tubular heat exchanger, the hot gas G flows around the profile body 4, 4', 4'', while the compressed air D, to be heated, flows inside the profiles. The flow-promoting configuration and the mutual disposition of the profile bodies 4, 4', 4'', as shown in FIG. 5, cause the frictional resistance on the gas side to be significantly less than in the case of the disposition of the pipes 2 of the heat exchanger of FIG. 2.

Figure 6:
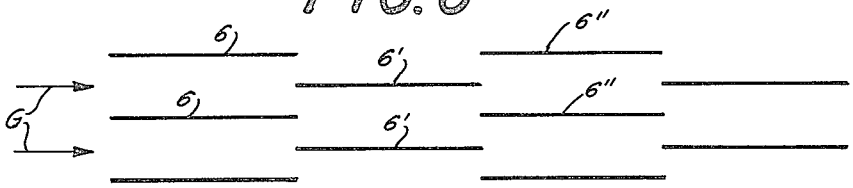
FIG. 6 illustrates hot gas flow with respect to flat plates.

In principle, the flow around the profile bodies 4, 4'4'', arranged as shown in FIG. 5, corresponds to the flow along the planes defined by offset plates 6, 6', 6'' of finite length of FIG. 6. In this arrangement, an optimum ratio of heat exchange performance to friction can be achieved. Consequently, a significantly higher flow velocity may be maintained along the profiles than in the case of the tubular heat exchanger. At the same time, the profile arrangement of FIG. 5 blocks the flow cross section on the gas side less than in the case of the tubular heat exchanger of FIGS. 1 or 2. It therefore follows that, under otherwise equal conditions, a significantly smaller gross cross section of flow of the matrix is required than in the case of the tubular heat exchanger. At the same time, very advantageous heat transfer conditions of the gas/profile surface result because of the high flow velocities permissible on the gas side. This improvement in the conditions under which the heat exchanger is operated, together with the low flow losses, result in an effectiveness on the gas side of the heat exchanger which is significantly better than that of the tubular heat exchanger.

FIG. 12 illustrates a heat exchanger according to the present invention including a main tube 3. Compressed air D is supplied to the main tube, flows through profiled bodies 37, and is discharged, as illustrated at D'. A housing 34 directs hot gasses G over the heat exchanger. Spacers 35, between the ends of bodies 37 and the housing, prevent any of the hot gasses G from flowing through spaces 36.

The external profiling and the disposition of the profile bodies 4, 4', 4'', of FIG. 5, or of the profile bodies 7 of FIG. 7*a*, or of the profile bodies 8 of FIG. 7*b*, are so designed that the cross section of gas flowing around the profiles in the regions of the profile inlet and outlet is much the same as the cross section at the sides of the profile. This is achieved by telescoping the profiles, whereby a maximum exchange area for given dimensions of the profile is achieved. With this disposition of the profiles, as with the offset plates 6, 6', 6'' of finite length of FIG. 6, it may be assumed that the reciprocal depression, starting from the rear edge of a profile, can be regarded as substantially level with the inlet of the following profile, so that optimum heat transfer conditions can again be expected here.

The profile bodies 7 of FIG. 7*a* are composed of small tubes 9, which are surrounded by a jacket shaped so as to promote flow. Jacket and small tubes 9, as well as the jacket halves at the profile inlet and outlet may be connected by soldering. This profile structure has the advantage that, in the case of a deficient solder joint or in the case of a local rupture of a soldered seam, no leaks of air/gas can develop. On the other hand, the paths between the profile inlet and the first small tube 9 as well as between the last small tube 9 and the profile outlet contribute only little to the heat transfer. Furthermore, there is a considerable thermal stress on the profile inlet and profile outlet, since these paths of the profile are not cooled directly by the internal flow, which is limited to the small tubes 9. However, the connection between the flow-conducting small tubes 9 and the main tube 3 can be obtained simply and in a proven manner by soldering, as in the case of the heat exchanger of FIG. 1.

The profile bodies 8 of FIG. 7*b* are assembled of specially structured shapes, preferably consisting of two halves 8', 8'' soldered together. In this case, air flows through the whole of the internal cross section of the profile body 8 with the exception of cross pieces. With this design, the whole surface of the profile takes part in the heat transfer and, at the same time, the above-mentioned thermal stresses at the profile inlet and outlet are reduced considerably.

Moreover, in the case of the profile structure of FIG. 7*b*, in order to connect the profile bodies 8, arranged in U-shaped fashion, with the main tube 3, specially shaped tube ends are required, which provide for a reshaping of the profile cross section into a series of parallel tubes corresponding to the profile of FIG. *7b* and which can be soldered to the main tube 3. Preferably, the air-guiding cross sections 10 are constructed triangularly in the sense of tapered ends, the remaining air-guiding cross section 11 on the other hand having a square shape.

Because of the larger cross section of flow, pressure losses on the air side are considerably less in the case of profiles designed as in FIG. *7b* than in the case of profiles with small tubes 9 as shown in FIG. *7a*. For this reason, the profile structure of FIG. *7b* is particularly attractive for direct heat exchange. On the other hand, the profile of FIG. *7a* is preferred for indirect heat exchange (see for instance FIG. 10) because of the smaller possibility of leakage at high pressures of the medium in the secondary cycle.

Because of the very small cross sections of the channels, the conditions of flow in the interior of the profiles (air side) correspond to those of the plate heat exchanger, i.e., the air flows at low Mach numbers and Reynold's numbers. By a suitable arrangement and shaping of the profiles, the flow conditions on the gas side (exterior flow) and the air side (interior flow) can be so matched that a minimum in pressure losses is achieved on the gas and air sides, while the heat transfer is an optimum. At the same time, the interior flow is laminar while the exterior flow is predominately turbulent.

The following relations are advantageous dimensions of the profiles and their dispositions (see FIG. 7).

| | |
|---|---|
| Profile length | l = 7 – 15 mm |
| Profile thickness | d = 1.0 – 2.0 mm |
| Number of chambers | 1 – 8 |
| clear lateral distance between profiles | b = 1.0 – 2.0 mm |
| Clear distance between profiles in the direction of flow | a = 4 – 9 mm |

Under optimum aerodynamic/thermodynamic conditions, the distance of travel for the flow on the gas side is relatively long, so that a larger number of rows of profiles must be arranged in series in the direction of flow. For this reason, the invention furthermore proposes rows of profile bodies, for example 8, which are arranged at an angle to the main tube 3, as shown by FIG. *8b* which is taken along line *8b*—*8b* of FIG. *8a*. The direction of flow of the hot gas G is therefore at an angle to the main tube 3, while in the case of the heat exchanger of FIG. 1 the gas flow G normally is directed perpendicularly to the main tube 3. The arrangement shown in FIG. 8 offers the advantage, in the case of the profile heat exchanger of this invention, that while achieving the desirable long distance of travel L of the gas flow G, the main tube 3 can be designed for the minimum cross section required, corresponding to that of the tubular heat exchanger, while at the same time a minimum gross structure volume (matrix + main tube) is achieved. It is advisable that the U-profiles or the profile bodies, for example bodies 8, as well as their connections to the main tube 3 be protected against excessive stresses from vibrations or sudden loads by the introduction of suitable baffle plates. As shown in FIG. 11, such baffle plates may be plates 13, provided with suitable openings 12, which are pushed over or laid upon the profile bodies 8. In addition, the plates 13 are arranged in the direction of flow G of the hot gas and act as spacers for the profile bodies. If desired, a row of compressed air boreholes 14 may be furnished for connecting a section of a channel of the main tube 3 with the corresponding interior of the profile body.

As shown in FIG. 8, the shaping of the U-profiles and "edgewise" U-bends is necessary in connection with the flow through the matrix corresponding to the simple cross/counterflow and with the intended simple arrangement of matrix relative to the main tube 3.

In addition to the U-profiles, or the profile body shape itself, shown in FIGS. 5 to *7b*, as well as in regard to their connection with the main tube 3, there are still other manufacturing and modification possibilities. For example, the profile bodies may be designed and arranged in lens-shaped form (not shown) in the direction of flow of the hot gas.

The effectiveness of the heat exchanger can be expressed by the parameter $$E = \cdot \frac{O}{V} \cdot \frac{Nu}{f \cdot Re} \cdot (T_4 - T_2)$$

in which

O/V represents the matrix density, i.e., the exchange surface area per unit volume on the gas side, Nu/f.Re represents a measure of the ratio of the heat exchanger performance to friction per unit of exchange surface area, and $T_4 - T_2$ represents the temperature gradient of the gas inlet/air inlet, available at the heat exchanger according to FIG. 9 on the basis of the heat exchanger inlet temperature permissible on the gas side.

The following relationships, which are to be compared, can be obtained with heat exchanger principles:

| | | Tube Heat Exchanger Tube Diameter 3 mm | Plate Heat Exchanger Channel Width 0.8 mm | Profile Heat Exchanger Profile Length 12 mm Profile type as in FIG. 7b |
|---|---|---|---|---|
| $O_{Gas}/V_{Matrix}$ | $m^2/m^3$ | 680 | 1200 | 900 |
| $T_4$-$T_2$ | K | 1200 – 600 = 600 | 1050 – 700 = 600 | 1200 – 600 = 600 |
| $(Nu/f.Re)_{air}$ | | 0.17–0.25 | 0.23–0.32 | 0.20–0.30 |
| $(Nu/f.Re)_{gas}$ | | 0.076 | 0.23–0.32 | 0.40–0.48 |
| E | K/m | 4.9–6.5 | 9.6–13.5 | $16.2–21.1.10^4$ |
| $E_{rel}$ | — | 1 | 2.0–2.1 | 3.3 |

This comparison shows that a higher effectiveness can be achieved with the profile heat exchanger of this invention than with the plate heat exchanger. At the same time, according to FIGS. 1 and 8, an extremely high thermal load-carrying capacity is assured because of the construction of the profile heat exchanger, just as in the case of the tubular heat exchanger.

The effect of the permissible inlet temperature $T_4$ on the gas side of the heat exchanger, on the temperature gradient $T_{WT}$, is illustrated in the graph of FIG. 9.

According to the comparison given above, the desired improvement in the heat exchanger effectiveness of the profile heat exchanger of this invention over that of the tubular heat exchanger is achieved by an improvement in the heat transfer/flow conditions on the gas side.

In the case of an indirect heat exchanger (FIG. 10), a "hot" and a "cold" matrix part 15 and 16 is designed with a heat carrier/secondary cycle 17 (preferably a liquid which does not change its physical condition, e.g., a liquid metal), so that the medium of the secondary cycle flows through the interior of the profile bodies, as shown, for example, in FIG. *7a*. Compressed air flows around the outside of the profile body on the air side (cold matrix part 16) or gas on the gas side in the case of the hot matrix part 15. This arrangement may be used, for example, in order to utilize one portion of the heat of the exhaust gas flow G of a gas turbine engine for bringing about additional heating of the compressor air VD which is to be supplied to the combustion chamber of the gas turbine engine.

Accordingly, with the arrangement shown in FIG. 10, the above-described advantages of flow around the profiles on the air and gas sides are utilized while the heat resistance in the interior of the profiles is practically neglegible in the case of a secondary cycle liquid medium.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A heat exchanger for heating compressed air by hot gas which flows in a particular direction through a region, comprising:

a main tube arrangement having an inlet section, for compressed air to be heated, and an outlet section, for heated compressed air, and a plurality of individual curved conduits projecting from the main tube arrangement into the region of hot gas flow, one end of each conduit being connected to said inlet section and the other end of each conduit being connected to said outlet section, so that the compressed air to be heated flows through the conduits, each conduit having an external cross-sectional shape, in a plane perpendicular to the direction of compressed air flow through it, which is elongated in the direction of hot gas flow, the upstream end of said cross-sectional shape being tapered toward the upstream direction of hot gas flow and the downstream end of said cross-sectional shape being tapered toward the downstream direction of hot gas flow, the exterior surfaces of the conduits being spaced from one another in all directions within a plane parallel to the hot gas flow, so that the hot gas can flow completely around each individual conduit, the conduits being arranged in rows, each row containing a number of side-by-side conduits nested within one another, and each two successive conduits in each row defining between their tapered ends a tapered space for accommodating the tapered end of a conduit in the next adjacent row, the tapered ends all being spaced apart to permit flow of hot gas between the conduits, the conduits being arranged with the lengths of their cross-sectional shapes at an acute angle to the longitudinal axis of the main tube arrangement, and the interior of each conduit having at least two compressed air guide channels, each of the channels having a generally triangular cross-sectional shape and occupying one of the tapered ends of the conduit, and a cross piece extending across the width of the conduit between the two channels.

2. A heat exchanger as defined in claim 1 wherein the conduits are lens-shaped in cross section.

3. A heat exchanger as defined in claim 1 wherein each conduit comprises two halves permanently joined together, the halves together defining the air guide channels within the conduit.

4. A heat exchanger as defined in claim 1 wherein each of the conduits is bent in an edgewise manner.

5. A heat exchanger as defined in claim 1 including baffle plates accommodating the conduits and serving to support the conduits and space them apart.

6. A heat exchanger as defined in claim 1 of the indirect type comprising two such heat exchangers, one being a hot part and the other a cold part, forming part of a closed system through which a secondary medium flows, the conduits of the hot part being adapted to project into the region of hot gas flow, and the conduits of the cold part being adapted to project into the region of flow of air to be heated.

7. A heat exchanger as defined in claim 1 in combination with a gas turbine engine, the exhaust of which provides the hot gas.

8. A heat exchanger ad defined in claim 1 including at least one air guide channel having a rectangular cross-sectional shape within each conduit, the rectangular air guide channel being located between the two triangular air guide channels, and a cross piece extending across the width of the conduit between each triangle channel and the rectangular channel.

* * * * *